US007560646B2

(12) United States Patent
Heffner

(10) Patent No.: US 7,560,646 B2
(45) Date of Patent: Jul. 14, 2009

(54) PROFILED INSULATION AND METHOD FOR MAKING THE SAME

(75) Inventor: Greg Heffner, Denver, PA (US)

(73) Assignee: Nexans (FR)

( * ) Notice: Subject to any disclaimer, the term of this patent is extended or adjusted under 35 U.S.C. 154(b) by 72 days.

(21) Appl. No.: 11/809,202

(22) Filed: May 31, 2007

(65) Prior Publication Data

US 2008/0296042 A1 Dec. 4, 2008

(51) Int. Cl.
*H01B 7/00* (2006.01)

(52) U.S. Cl. ..... 174/110 R; 174/112; 174/113 R; 174/113 AS

(58) Field of Classification Search ..... 174/36, 174/110 R, 113 R, 113 AS, 120 R, 120 SP
See application file for complete search history.

(56) References Cited

U.S. PATENT DOCUMENTS

| | | | | |
|---|---|---|---|---|
| 2,137,887 | A | 11/1938 | Abbott | 173/244 |
| 2,583,025 | A * | 1/1952 | Swift et al. | 174/117 R |
| 2,583,026 | A * | 1/1952 | Swift | 174/117 R |
| 3,164,948 | A | 1/1965 | Stratford | 57/140 |
| 3,430,994 | A | 3/1969 | Keeler, II | 287/53 |
| 3,445,052 | A | 5/1969 | Lewallen | 229/16 |
| 3,771,934 | A | 11/1973 | Delves-Broughton | 425/135 |
| 4,073,673 | A | 2/1978 | Raabe et al. | 156/244 |
| 4,474,426 | A | 10/1984 | Yataki | 350/96.23 |
| 4,479,702 | A | 10/1984 | Pryor et al. | 350/96.23 |
| 5,922,155 | A | 7/1999 | Clouet et al. | 156/51 |
| 5,990,419 | A * | 11/1999 | Bogese, II | 174/120 R |
| 6,743,983 | B2 | 6/2004 | Wiekhorst et al. | 174/80 |
| 6,815,617 | B1 * | 11/2004 | Gebs et al. | 174/113 AS |
| 6,914,193 | B2 * | 7/2005 | Ware et al. | 174/110 R |
| 7,205,479 | B2 * | 4/2007 | Caveney | 174/110 R |
| 7,256,351 | B2 * | 8/2007 | Dillon et al. | 174/113 R |
| 7,271,344 | B1 * | 9/2007 | Stutzman et al. | 174/113 R |
| 2006/0118322 | A1 * | 6/2006 | Wiekhorst et al. | 174/110 R |

FOREIGN PATENT DOCUMENTS

| | | |
|---|---|---|
| EP | 0560050 | 9/1993 |
| FR | 2141599 | 6/1971 |
| FR | 2613981 | 10/1988 |
| WO | WO9417534 | 8/1994 |

OTHER PUBLICATIONS

European Search Report dated Aug. 21, 2008.

* cited by examiner

*Primary Examiner*—William H Mayo, III
(74) *Attorney, Agent, or Firm*—Sofer & Haroun, LLP

(57) ABSTRACT

A wire has a conductor and an insulation extruded onto the conductor. The insulation has a plurality of alternating crests and crevasses, where the ratio of the distance from the conductor to a top of the crest to the distance from the conductor to a lowest point in the adjacent crevasse is at least 1.1 and where the ratio is sustained within a tolerance variation of not more than 15% along the length of the wire.

14 Claims, 5 Drawing Sheets

PROFILED INSULATION AND METHOD FOR MAKING THE SAME

BACKGROUND OF THE INVENTION

1. Field of the Invention

The present invention is in the fields of cables and cable production. More particularly, the present invention is related to a profiled insulation for cables and the method for making the same.

2. Description of the Related Art

Copper cables are used for a variety of tasks, such as power transmission and signal transmission. In such tasks, the choice of insulation is of particular concern. In the area of signal transmission, for example, twisted pairs of copper conductors used in data cables (e.g. LAN cables) must meet certain fire safety standards and be cost effective, while minimizing signal degradation. Such signal degradation may be caused by factors such as interference with adjacent conductors, and inductance with the insulation.

Thus, in developing copper wire signal cables, often having multiple twisted pairs of copper wire within the same jacket, there are the competing concerns of minimizing cost while maximizing signal strength and clarity.

In order for the cable to function properly, the impedance measurement between the two copper conductors of a twisted pair must be precisely maintained. This is achieved by insulating the conductor with a dielectric material. However, the dielectric material has a negative impact on the electrical signal and contributes to signal losses as well as other undesirable electrical phenomena. In addition, this dielectric material adds cost to the cable construction and often has a negative impact on cable fire performance in UL testing. Thus it is desirable to find ways to reduce the amount of dielectric material in proximity to the copper conductor without affecting the impedance between the two copper conductors forming the twisted pair.

Several approaches have been taken in the past to reduce the amount of dielectric material in proximity to the copper conductors without reducing the impedance of the twisted pair made from said copper conductors. For example, some manufacturers have replaced typical copper wire dielectric insulation with a foamed dielectric insulation which adds a gas component to the insulation. This yields a reduction in the amount of dielectric material necessary to maintain the impedance of the twisted pair. It is known that the typical gases used to foam dielectric materials have a dielectric constant close to 1 (most desirable), whereas all other dielectric materials known at present have a dielectric constant substantially greater than 1, so this approach would appear, at first glance, to aid in resolving the concerns. However, this method not only greatly increases the complexity of the extrusion process, but often requires additional manufacturing equipment. It is also much more difficult to manufacture a data communications cable with good electrical properties using this type of process.

Another method to reduce the amount of insulation while simultaneously maintaining the impedance between a twisted pair of conductors is to add openings (air or inert gas filled) within the insulation itself. However, prior art methods for producing such insulation with longitudinal air/gas openings have either completely failed due to extrusion designs that do not produce the intended results or have otherwise produced ineffective results due to inconsistencies in the stable production of the openings.

Yet another manner for maintaining the impedance between a twisted pair of conductors while reducing the amount of insulation material used within a signal cable is to use what is termed "profiled" insulation. Profiled insulation refers to an insulation that is provided around a copper wire conductor, the cross-section of which is other than substantially circular. Such examples of profiled insulation may include comb-tooth structures or other similar designs intended to both separate the conductors from one another while using less insulation than a solid insulator of similar diameter but yielding the same impedance between twisted pairs of conductors. However, even with this method there are a number of drawbacks. First, it is difficult to achieve the desired shapes of the contoured insulation. Many of the desired insulation shapes are either too difficult or impossible to make under typical copper wire insulation extrusion lines conditions. Moreover, even if a particular design can be made for the insulation, they are typically generated using a manner, such as a shaped extrusion die (FIG. 1), that provides an inconsistent product, caused by such factors as increased shear rate from the die, and other production line conditions that are caused by the equipment used to generate the profiled insulation.

BRIEF SUMMARY OF THE INVENTION

The present invention looks to overcome the drawbacks associated with the prior art and provides a profiled insulation and method for making the same. The profiled insulation is dimensioned so as to produce the optimum results, balancing the need to achieve a desired impedance value between a twisted pair of copper conductors within a cable, with the need for reduced amounts of insulation to prevent inductive loss. Additionally, the profiled insulation is of such dimension that it can be manufactured in a cost effective (reduced total insulation per length of cable) and commercially reproducible manner (i.e. consistent electrical properties) under copper wire line extrusion. Such method for production may advantageously use a modified extrusion die that generates the profiled insulation in this consistent manner.

To this end, the present invention provides for a wire having a conductor and an insulation extruded onto the conductor. The insulation has a plurality of alternating crests and crevasses, where the ratio of the distance from the conductor to a top of the crest to the distance from the conductor to a lowest point in the adjacent crevasse is at least 1.1 and where the ratio is sustained within a tolerance variation of not more than 15% along the length of the wire.

DETAILED DESCRIPTION

Figure 2:
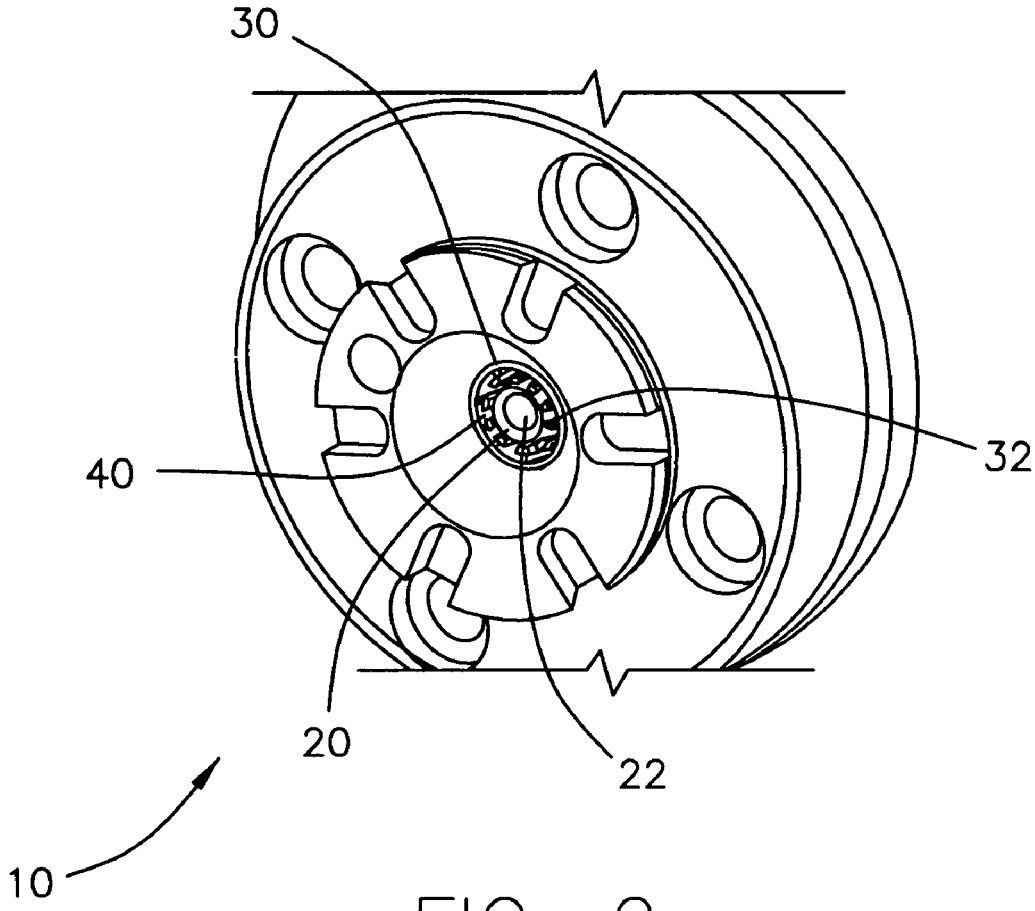
FIG. 2 is perspective of an extrusion head, tip and die, in accordance with one embodiment.

In one embodiment, FIG. 2 illustrates an extrusion head 10 used for extrusion of profiled insulation onto conductors for use in wires, such as telecommunications/electronic signal wires. Extrusion head 10 is utilized in a typical extrusion line format, whereby a conductor is drawn through head 10, onto which the molten insulator is applied. For the purposes of illustration the present invention contemplates that the conductors being coated are copper wire conductors and the insulation is FEP (Fluorinated Ethylene Propylene), for use in twisted pair communication wires used in LAN (Local Area Network) cables. However, it is understood that the embodiments described herein are equally applicable to other polymer insulations and polymer insulation combinations typically manufactured using line extrusion.

As shown in FIG. 2, extrusion head 10 maintains an extrusion tip 20, having a central opening 22. Arranged around the external circumference of tip 20 is an extrusion die 30, the two forming a polymer channel 40 between the internal circumference of the die 30 and external circumference of tip 20.

Projecting from the internal diameter of tip 30 are blockades 32 which form polymer flow barriers with polymer channel 40. As shown in cross-sectional FIG. 3, the blockades 32 of die 30 are attached to the internal circumference of die 30 by way of support fins 34. It is noted that fins 34 for blockades 32 are dimensioned such that they extend longitudinally along some length between blockade 32 and the inside diameter of die 30 so as to make sure blockades 32 are well supported. This support prevents unwanted deflection of blockades 32 by the weight/force of the extruding polymer, preventing unwanted fluctuations in the resulting extruded insulator product.

In one embodiment, blockades 32 may be formed from the same material as die 30, whereby blockades 32 and support fins 34 are manufactured using EDM (Electrode Discharge Machine). Alternatively, both die 30 and blockades 32 may be formed using ceramic or other melt proof stable materials. It is understood that die 30 and blockades 32 may also be formed as composites, with blockades 32 being formed of a first material and die 30 being formed from a second different material.

Figure 3:
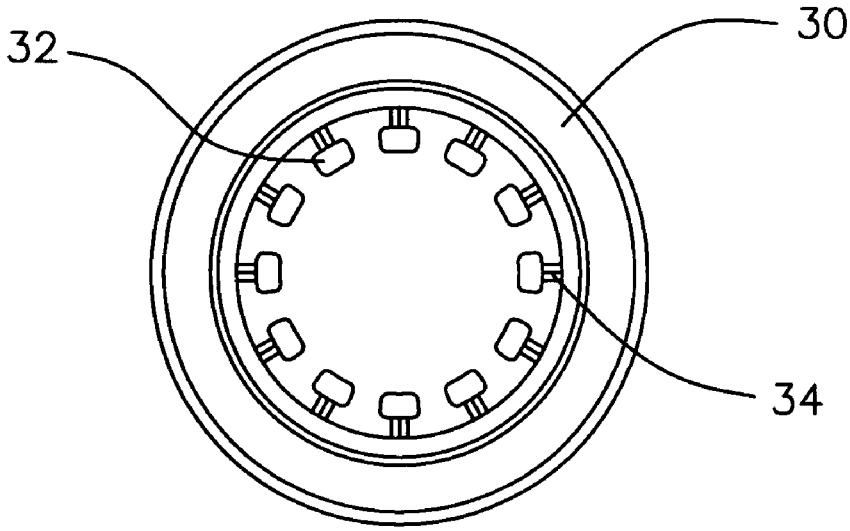
FIG. 3 is a cross section of the extrusion die from FIG. 2, in accordance with one embodiment.
Figure 4:
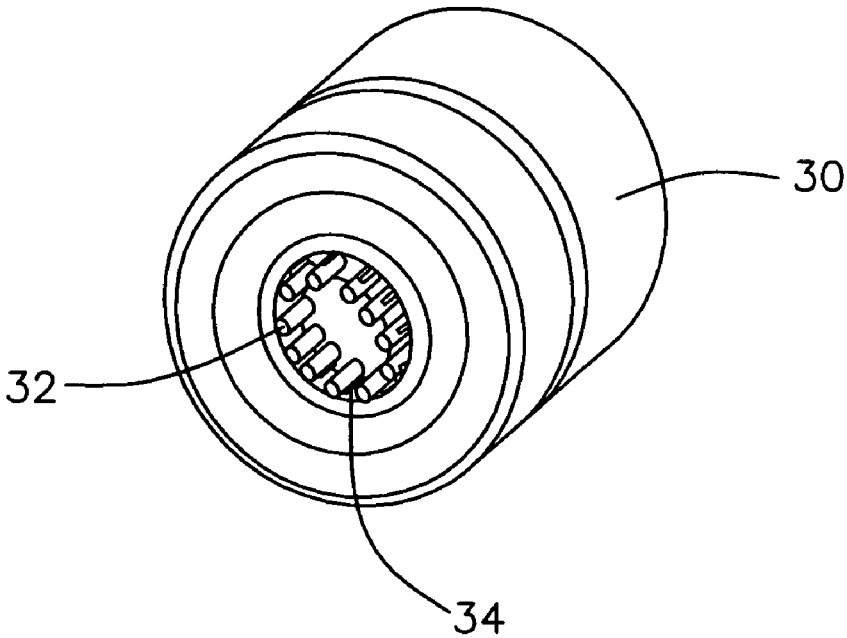
FIG. 4 is cross section of an another extrusion die, in accordance with one embodiment.

As shown in FIGS. 2-3 blockades 32 have a rounded trapezoid shape. In another embodiment of the present invention, FIG. 4 shows an alternative die 30 having circular blockades 32 instead of the trapezoid shaped blockades in FIGS. 2-3. As discussed in more detail below, the specific dimensions of die 30 and blockades 32 can be varied and have an impact on the final shape of the produced profiled insulation.

Accordingly, when insulation is extruded onto a conductor using die 30 as described, the polymer flows through polymer channel 40 between tip 20 and die 30, such that the flow is uniformly interrupted by blockades 32 just as the polymer exits extrusion head 10. The resulting flow interruption forces the polymer around blockades 32 in such a way that the suction effect at the exit end of blockades 32 cause the polymer to collapse on itself resulting in the outer circumference of the polymer insulation having a contoured surface with crevasses corresponding to each of blockades 32 on die 30.

Figure 5:
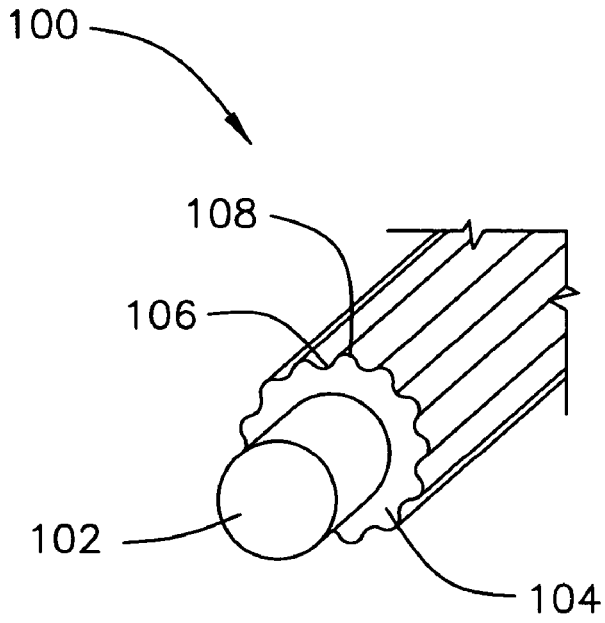
FIG. 5 is an illustration of a profiled insulation made using the extrusion head of FIG. 2, in accordance with one embodiment.
Figure 6:
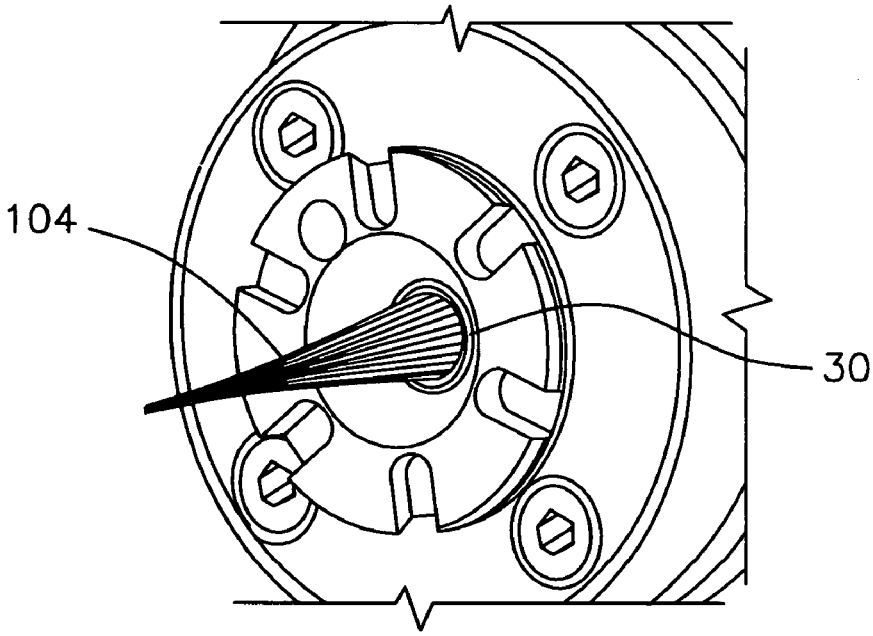
FIG. 6 illustrates the profiled insulation of FIG. 5 as it exits the extrusion head of FIG. 2, in accordance with one embodiment.

For example, FIG. 5 shows a wire 100, having conductor 102 and a profiled insulation 104 thereon. The outer circumference of insulator 104 is contoured having alternating crevasses 106 and crests 108. FIG. 6 illustrates the production of wire 100 via extrusion head 10 using draw down type-extrusion.

As noted above the dimensions of die 30 and blockades 32 have a large impact on the depth of crevasses 106 and height of crests 108.

Figure 7:
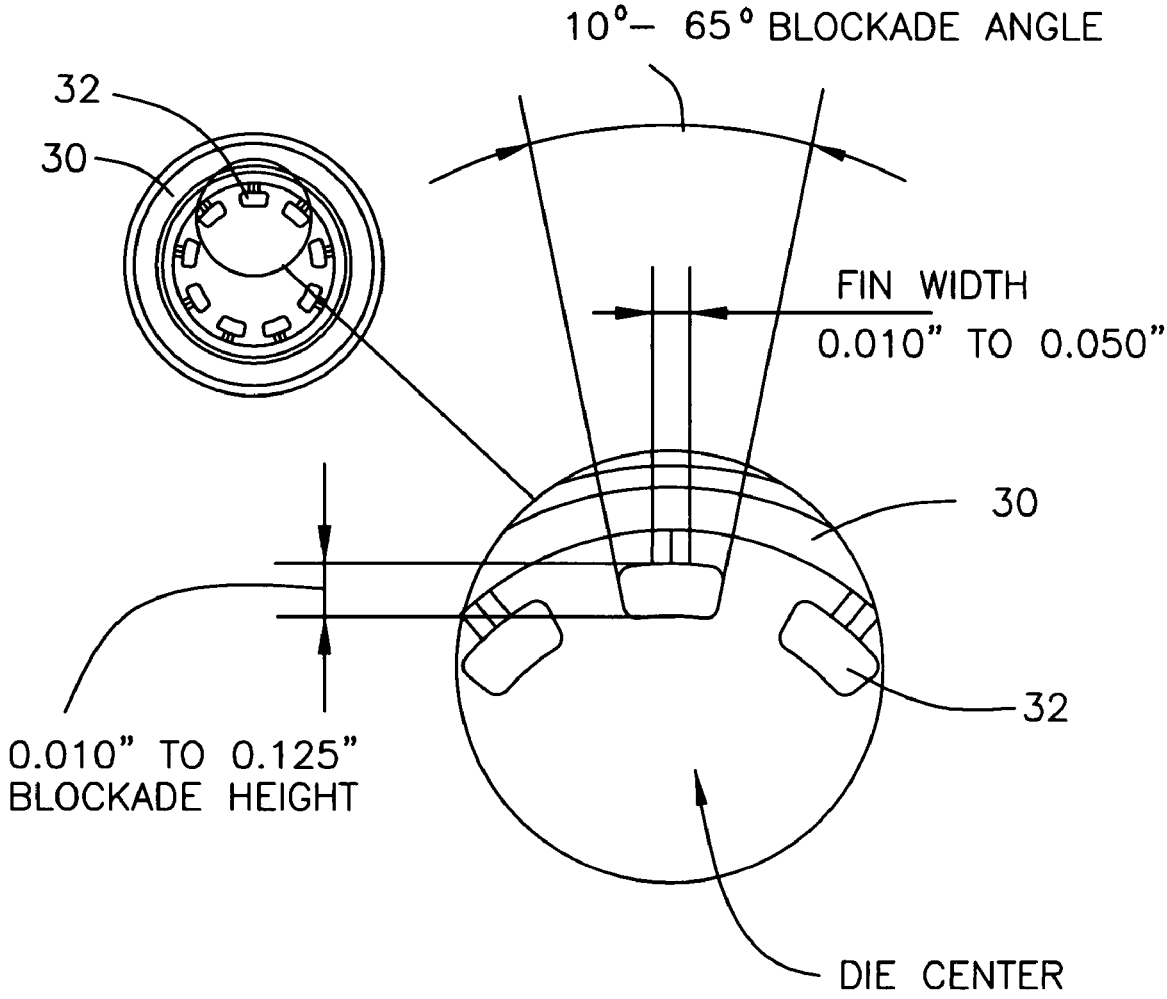
FIG. 7 is a close up figure of the blockades and extrusion die from FIG. 2, in accordance with one embodiment.

For example, in one embodiment, die 30, blockades 32 and tip 20 are preferably dimensioned in range of: external tip diameter –0.125"-0.400"; internal die 30 diameter –0.250"-0.625"; having a DDR (Draw Down Ratio) of 2:1-250:1. Regarding blockades 32, as shown in close up FIG. 7, trapezoid shaped blockades 32 preferably have an angle substantially in the range of 10° to 65° and a height of substantially 0.010" top 0.050."

The following table 1 shows the resultant dimensions in insulation 104 extruded under these conditions and using such die 30 and trapezoid blockade 32 dimensions, including thickness to crests 108, thickness to crevasses 106 as well as the ratio of crests 108 to crevasses 106 relative to the diameter of conductor 102.

TABLE 1

| | Trap. Angle | Trap. Height | Fin Width | Die ID | Tip OD | Cond. to Crest | Cond. to Crevasse | Crest/ Crevasse Ratio |
|---|---|---|---|---|---|---|---|---|
| 4 Trap. Blockades | 30° | 0.018" | 0.020" | 0.325" | 0.200" | 0.0095" | 0.0052" | 1.82 |
| 9 Trap. Blockades | 23° | 0.040" | 0.030" | 0.500" | 0.300" | 0.0075" | 0.0045" | 1.66 |
| 12 Trap. Blockades | 19° | 0.032" | 0.030" | 0.380" | 0.200" | 0.0068" | 0.0052" | 1.30 |
| 12 Trap. HR Blockades | 19° | 0.040" | 0.030" | 0.500" | 0.275" | 0.0071" | 0.0052" | 1.36 |

Figure 8:
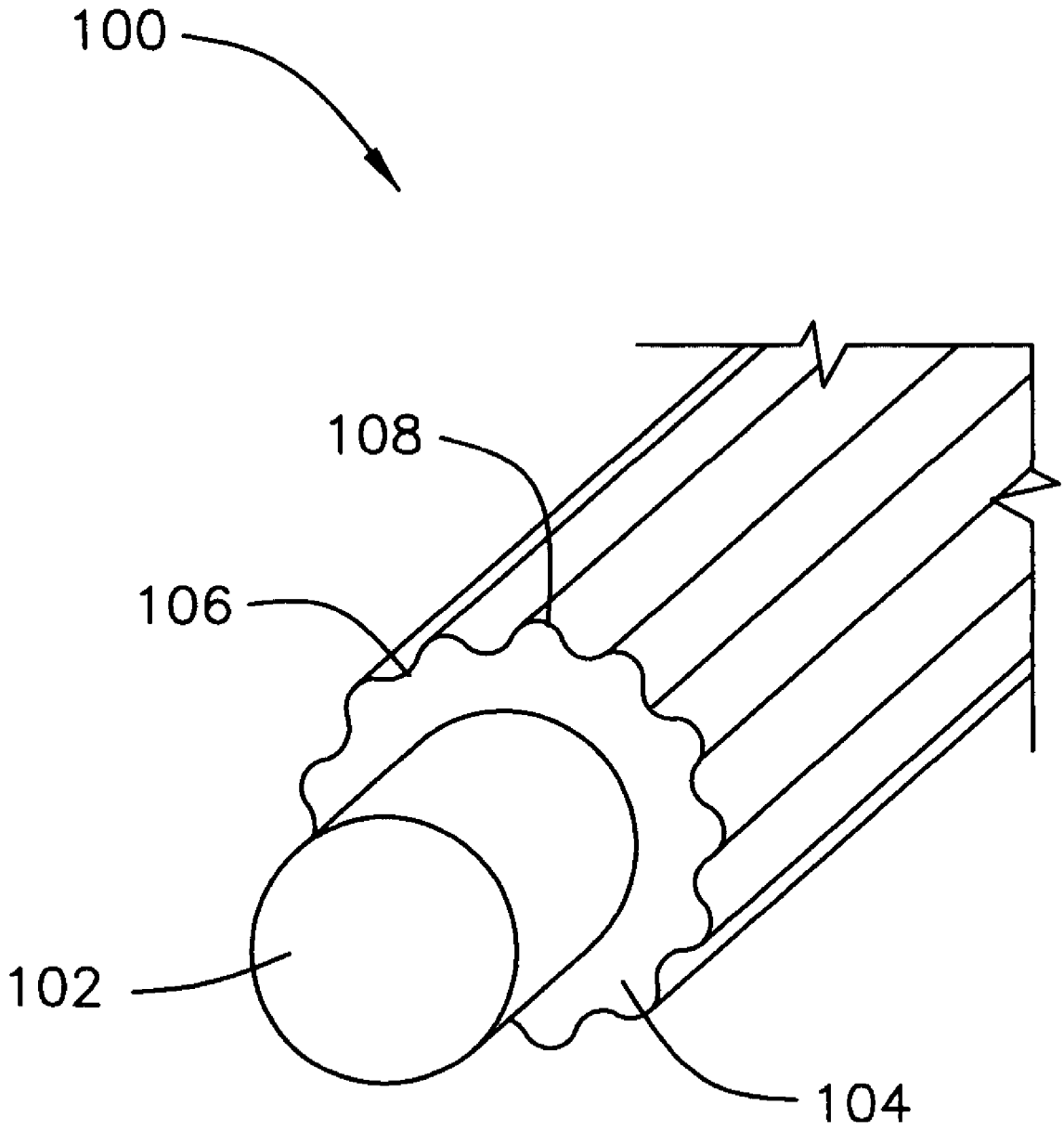
FIG. 8 is an alternative profiled insulation generated using the die in FIG. 4, in accordance with one embodiment.

As noted above different dimensions/shapes for blockades 32 result in different dimensions for contoured insulation 104 of wire 100. The present invention contemplates that different polygonal shapes or combinations of curved and straight edges may be used for blockades 32. For example, as shown in FIG. 8, instead of using the trapezoid shaped blockades 32 from FIGS. 2-3, if circular cross section blockades 32 from FIG. 4 are used the results are different, having shallower crevasses 106, and thus displaying a lesser difference between crevasse 106 height and crest 108 height.

For example, in one embodiment, die 30, blockades 32 and tip 20 are preferably dimensioned in range of: external tip diameter –0.125"-0.400"; internal die 30 diameter –0.250"-0.625"; having a DDR (Draw Down Ratio) of 2:1-250:1. Regarding blockades 32, circular/cylindrical shaped blockades 32 preferably have an angle substantially in the range of 10° to 65° and a height of substantially 0.010" to 0.125."

The following table 2 shows the resultant dimensions in insulation 104 extruded under these conditions and using such die 30 and circular blockade 32 dimensions, including thickness to crests 108, thickness to crevasses 106 as well as the ratio of crests 108 to crevasses 106 relative to the diameter of conductor 102.

TABLE 2

| | Adjacent Blockade Angle | Cirular Blockade Diameter | Fin Width | Die ID | Tip OD | Cond. to Crevasse | Cond. to Crest | Crest/ Crevasse Ratio |
|---|---|---|---|---|---|---|---|---|
| 6 Circular Blockades | 60° | 0.035" | 0.030" | 0.348" | 0.200" | 0.0072" | 0.0068" | 1.05 |

As is seen from the above data in Tables 1 and 2, the shape and dimensions of the blockades 32 have a significant impact on the shape and depth of crevasses 106 and crests 108 in insulation 104, with varying effects on the resultant reduction in polymer thus obtained. The following table 3 shows the reduction in polymer (in square inches reduction relative to a cross section of a polymer insulation from a die of similar dimensions that does not have blockades 32.

TABLE 3

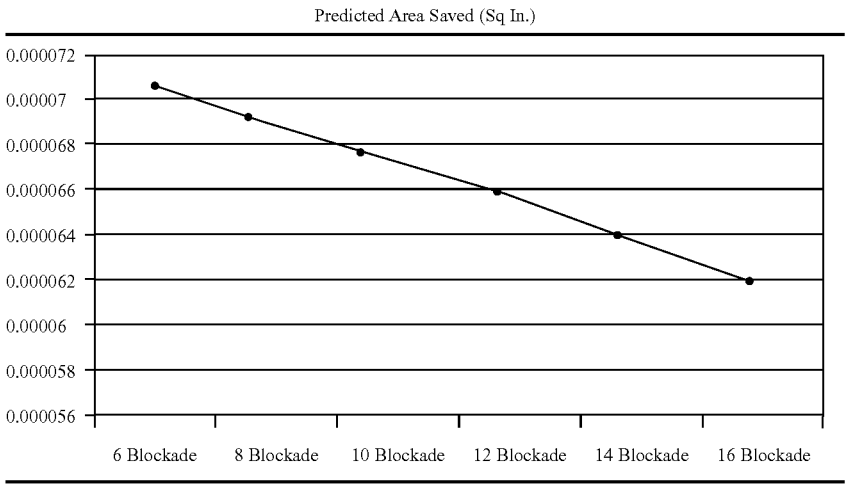

Thus, according to the above, specifically dimensioned profiled insulation 104 is generated for wires 100. However, it is understood that minor modifications may be made while keeping within the scope of the invention such as the use of various shaped blockades 32, different draw down ratios etc. . . .

The resulting profiled insulation 104 on wire 100 is such that the ratio obtained by taking the distance from crest 108 to conductor 102 and dividing by the distance of an adjacent crevasse 106 to conductor should preferably be at least 1.1 and preferably greater than 1.3 presenting ideal separation between adjacent conductors 102 in a twisted pair while also reducing the amount of insulation 104 used.

As such, wire 100, as discussed above has numerous advantages including the reduction in total polymer 104 usage while increasing the distance between conductors 102 in adjacent wires 100. Such profiled insulation 104 dimensions are such that this separation is maintained along the length of wire 100 (i.e. nesting is avoided), while also maintaining sufficient crush resistance comparable to standard non-profiled insulation.

For example the following table 4 represents the predicted nesting ability of a twisted pair formed from two wires 100 for a fixed insulation diameter and shape. The difference in vertical change on the graph shows the possibility of the conductor to conductor distance in a twisted pair being greater using fewer blockades 32. Variation in conductor 102 to conductor 102 distance is to be avoided by a compromise in the number of blockades 32 as mentioned above.

TABLE 4

Predicted Nesting Dimesions (3 × 0 as base)

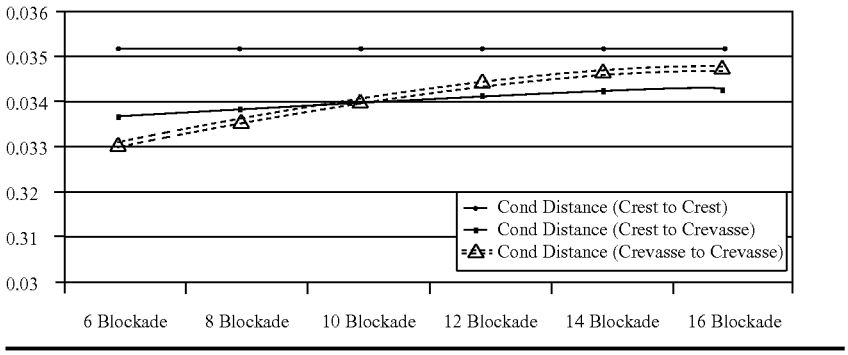

Figure 1:
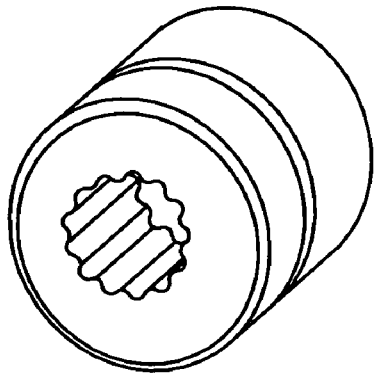
FIG. 1 (PRIOR ART)
FIG. 1 is prior art extrusion die for making profiled insulation.

Furthermore, as noted above, wire produced using blockade die 30 is produced faster and with more stable and consistent results. One reason for such results is the significant reduction in shear rate variation at the extrusion head between the prior art shaped die in FIG. 1 and the blockade dies of FIGS. 2-4. For example, shear rates for the prior art die shown in FIG. 1 may range from 30.265 (l/s) to 205.02 (l/s) at 28.86 kg/hr extrusion rate. On the other hand, shear rates for die 30 from FIGS. 2-3 (trapezoid shape 12 blockades 32) ranges from 48.87 (l/s) to 122.60 (l/s) at 28.86 kg/hr with a resulting reduction of shear rate variation of 39.8%.

The resulting insulation 104 on wire 100 is such that it maintains concentricity. For example, taking any one crest 108 having the greatest distance from conductor 102 and comparing it to the a crest 108 having the shortest distance from conductor 102 at any one cross-section along the length of wire 100 should not vary more than 15% and preferably not more than 10% so as to maintain consistent electrical properties along the entire length of wire 100.

Additionally, the resulting insulation 104 is preferably symmetrical around the circumference of wire 100. For example, the standard deviation of the center to center distance between the center of adjacent crests 108 when divided by the mean distance between the adjacent crest 108 is less than 0.10 and preferably less than 0.05.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A wire, said wire comprising:

a conductor; and a conductor insulation extruded directly onto an entire outer surface of said conductor, said conductor insulation having a plurality of alternating crests and crevasses along its outer circumference, wherein the ratio of the distance from said conductor to a top of said crest to the distance from said conductor to a lowest point in said adjacent crevasse around the circumference of said conductor is at least 1.1 and wherein said ratio is sustained within a tolerance variation of not more than 15% along the length of said wire.

2. A wire as claimed in claim 1, wherein said ratio of the distance from said conductor to a top of said crest to the distance from said conductor to a lowest point in said adjacent crevasse is at least 1.3.

3. A wire as claimed in claim 1, wherein said ratio of the distance from said conductor to a top of said crest to the distance from said conductor to a lowest point in said adjacent crevasse is sustained within a tolerance variation of not more than 10% along the length of said wire.

4. A wire as claimed in claim 1, wherein said crevasses and adjacent crests are formed during extrusion.

5. A wire as claimed in claim 4, wherein said crevasses and adjacent crests are formed during extrusion by blockades positioned in a polymer chamber between an extrusion die and an extrusion tip.

6. A wire as claimed in claim 5, wherein said blockades cause a polymer flow deformation in said polymer chamber, such that said crevasses in said conductor insulation are in spatial relationship with corresponding blockades.

7. A wire as claimed in claim 5, wherein said blockades are trapezoid shaped.

8. A wire as claimed in claim 5, wherein said blockades are polygon shaped.

9. A wire as claimed in claim 5, wherein said blockades are circular/cylindrical in shape.

10. A wire as claimed in claim 5, wherein said blockade shapes can be described as combinations of curved surfaces and straight lines.

11. A wire as claimed in claim 1, wherein said insulation is FEP (Fluorinated Ethylene Propylene).

12. A wire as claimed in claim 1, wherein said extrusion is a draw down type extrusion.

13. A wire as claimed in claim 12, wherein said drawn down type extrusion is carried out under a drawn ratio substantially in the range of 2:1-250:1.

14. A twisted pair conductor formed from two wires according to claim 1.

* * * * *